US006453563B1

(12) United States Patent
Farland

(10) Patent No.: US 6,453,563 B1
(45) Date of Patent: Sep. 24, 2002

(54) HAND TOOL HANDLE

(75) Inventor: Rick Farland, Sturbridge, MA (US)

(73) Assignee: Hyde Manufacturing Company, Inc., Southbridge, MA (US)

( * ) Notice: Subject to any disclaimer, the term of this patent is extended or adjusted under 35 U.S.C. 154(b) by 0 days.

(21) Appl. No.: 09/755,563

(22) Filed: Jan. 5, 2001

(51) Int. Cl.[7] ..... B26B 1/00; B05C 1/00; B25G 1/00

(52) U.S. Cl. ..... 30/329; 15/245.1; 16/114 R; 30/169; 30/340

(58) Field of Search ..... 30/169, 329, 340; D8/7; 15/236.1, 245.1; 16/400

(56) References Cited

U.S. PATENT DOCUMENTS 4,770,712 A * 9/1988 Hopkins ..... 134/6
5,303,469 A * 4/1994 Yin-Han ..... 30/122
5,615,445 A * 4/1997 Kelsay et al. ..... 15/143.1

* cited by examiner

*Primary Examiner*—Allan N. Shoap
*Assistant Examiner*—Isaac Hamilton
(74) *Attorney, Agent, or Firm*—Lackenbach Siegel LLP

(57) ABSTRACT

A hand tool handle has two interlocking first and second hollow molded plastic parts. The first part is formed with a peripheral lip. The second part is formed with transversely disposed peripheral surfaces inwardly disposed of the peripheral lip. Each handle part is formed a first plastic material and with a molded over second softer plastic material which covers the hand grip portion but not the peripheral lip or the peripheral surfaces. A tool blade is disposed between the interlocked handle parts. Rivets and a grommet provide pressed engagement of the handle parts with tight sealing of the peripheral lip. The hollow handle parts have respective facingly opposed structural ribs having respective spacedly disposed free ends to maximize the pressing engagement and insure sealing the peripheral lip.

6 Claims, 5 Drawing Sheets

HAND TOOL HANDLE

BACKGROUND OF THE INVENTION

1. Field of the Invention

This invention relates to hand tools and hand tool handles. Specifically, this invention relates to bladed hand tools such as cutlery, taping knives and putty knives.

2. Background and Discussion of the Prior Art

Bladed hand tools, such as cutlery, taping knives and putty knives, are often used in wet environments. Such knives are often fully submerged for cleaning. Present day knives are generally hollow handles formed of injection moldable hard plastic, such as glass-filed nylons and polyolefins. These hard plastic handles were undesirable for extensive professional use, insofar as they would cause callouses and fatigue. The knife art was also directed towards hollow lightweight plastic handles. When such hollow plastic handles are used, water tight seals had to be maintained around the joints in the component plastic parts, because water would otherwise seep or leak between the parts and into the hollow structure. The joints caused pinching of the hand. Manufacturing and final assembly practicalities generally precluded water tight seals at the joints.

One long tried approach to solve the problems of fatigue, pinching and water seepage was to provide a molded around soft outer plastic material which covered the joints and encased and secured the inner plastic handle parts. This well known construction is disclosed in Fr. 2,597,387 to Peppini; U.S. Pat. No. 4,712,304, granted Dec. 15, 1987 to Sanelli; and U.S. Pat. No. 5,615,445, granted Apr. 1, 1997 to Kelsay et al. The approach taken by Peppini, Sanelli and Kelsay et al relied on a soft plastic molded around outer layer to secure and seal the plastic handle parts. The soft outer plastic would however, with time and wear, thin and crack particularly at the joints. The art sought a more time and wear effective water tight construction, while nonetheless providing a comfortable, non-pinching hand grip. The present invention provides that solution.

SUMMARY OF THE INVENTION

A hand tool handle has two opposed interengaging first and second hollow molded plastic parts. Each part is formed with a molded over soft plastic grip portion. The parts are formed to be interengaged by opposed post and hole construction, with a tool blade disposed therebetween at the distal end. The first or upper part is formed with a peripheral lip and a juxtaposed inner peripheral surface. The second or lower part is formed with transversly disposed peripheral surfaces. The parts when interengaged have respective first and second peripheral surfaces in mating contact, with the first part peripheral lip covering and the contactingly engaging the second part peripheral surface. The peripheral lip and peripheral surfaces are free of the outer layer soft grip material. The peripheral lip extends from the proximate end of the handle along the sides and transversely of the distal end adjacent the blade securement portion. Rivets and a grommet provide a tight pressing seal of the lip and peripheral surfaces while securing the blade between the handle parts at the distal end.

The first and second handle parts are formed with structural ribs extending from about the distal end to the proximate end of the handle. The free ends of the respective structural ribs are facingly disposed, but slightly spaced from each other. This spaced disposition insures tight contacting seating of the peripheral lip and respective peripheral surfaces, when the parts are pressingly secured by the grommet and rivets. The structural ribs then do not interfere with but instead insure the desired tight peripheral seal. This peripheral lip construction also prevents pinching of the hand.

The assembled bladed hand tool provides a soft outer grip portion which prevents fatigue in extensive professional use, while providing a peripheral lip seal of the pressingly engaged first and second handle parts.

DESCRIPTION OF THE PREFERRED EMBODIMENTS

Figure 1:
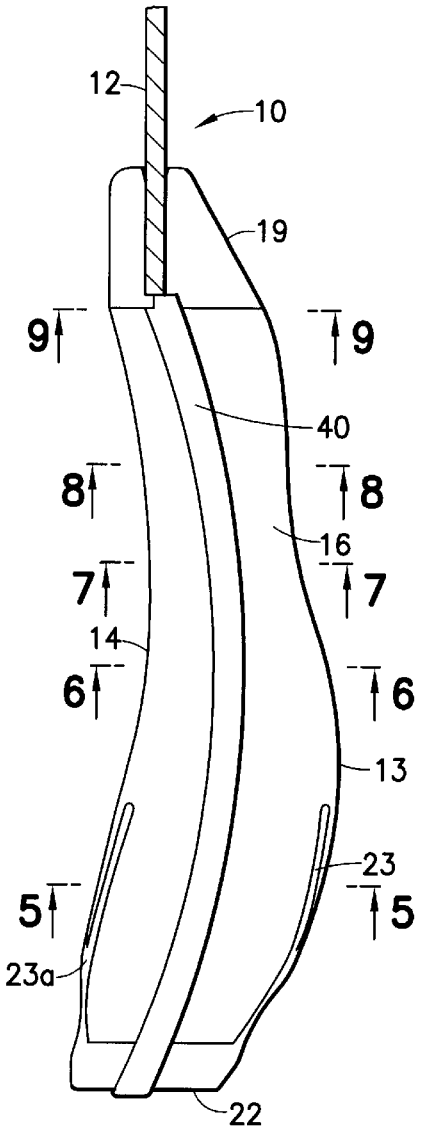
FIG. 1 is a side elevational partial fragmentary view of the tool of the present invention.

Referring to the FIGS., there is shown taping knife or hand tool 10 of the present invention. Hand tool 10, in general, comprises handle 11 and a taping knife blade 12. Handle 11, in general terms, comprises a first or upper handle part 13 and a second or lower handle part 14.

Upper handle part 13 is formed of an inner hard plastic member 15 and an outer soft plastic grip material or upper portion 16 which is thermoplastically bonded to member 15. Member 15 is formed with a distal end portion 17 which has transversely disposed distal end 18 and a distally tapered portion 19 for receiving blade 12, a body portion 20 having distally disposed recess 30 for receiving outer grip portion 16, and a rounded raised proximately disposed portion 21 having transversely disposed proximate end 22. Portion 21 is formed with three outer elongated distally extending ribs 23, 24 and 25 and a tapered hole 26, for respective purposes hereinafter appearing. Upper handle part 13 is formed with a series of transversely disposed ribs 31, 32, 33, 34, 35, 36, 37 and 38 which are interconnected by central elongated rib 39. Ribs 31–39 are for structural purposes.

Upper handle part 13 is formed with a peripheral lip 40 which extends from one side 41 of distal end portion 17 around the handle periphery to the other side 42 of distal end portion 17. A transversely disposed enlarged lip 40*a* completes the peripheral lip 40. Lip 40 is formed with an outwardly extending horizontally disposed surface 43, a contiguous vertically disposed peripheral or side wall surface 44, a contiguous bottom or end surface or edge 45, a contiguous vertically inwardly disposed surface 46, and a contiguous horizontally inwardly disposed surface 47, as best shown in FIGS. 5–11. Surface 46 is formed in three angularly disposed segments 93, 94 and 95 on opposite sides of part 13, and connected by contiguous proximately disposed end portion 96. Lip 40, particularly peripheral wall surface 44, is free of outer grip material 16. End surface 45 and the outermost portion 48 of surface 43 are also free of outer grip material 16. In this manner of construction, lip 40 is substantially free of outer grip material 16.

Figure 2:
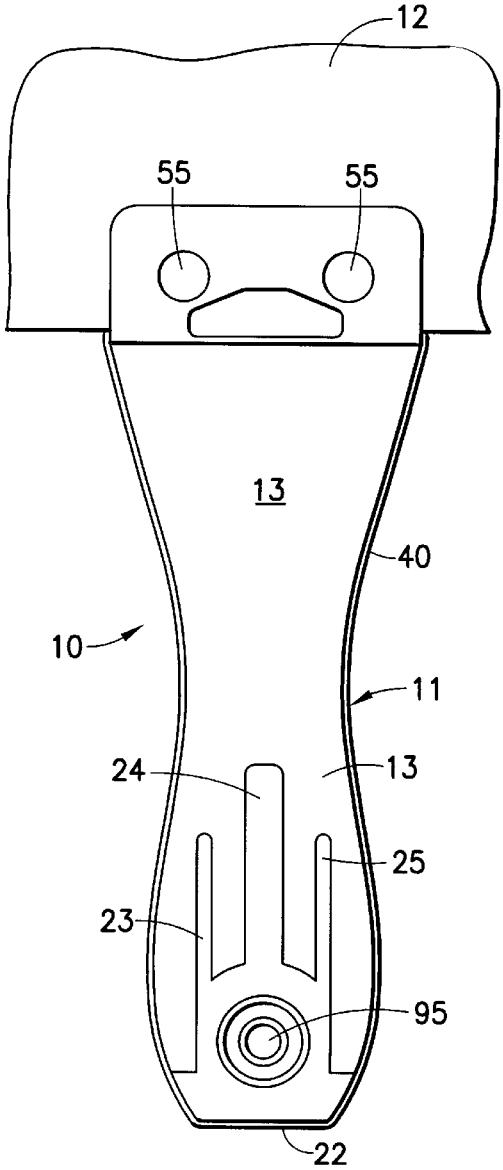
FIG. 2 in a top plan view of the hand tool of FIG. 1.
Figure 10:
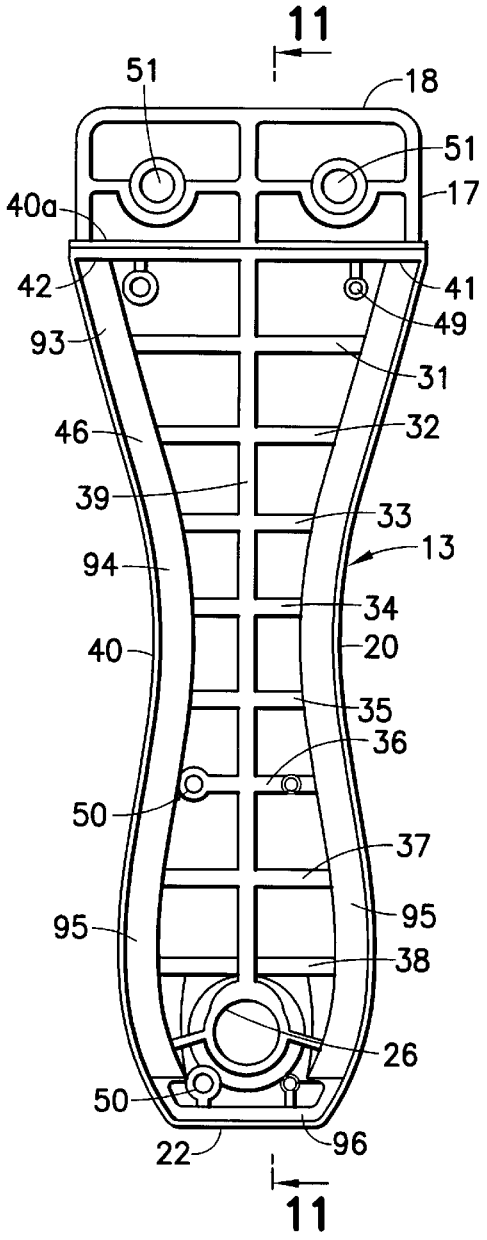
FIG. 10 is a bottom plan view of the upper handle part inner member.
Figure 11:
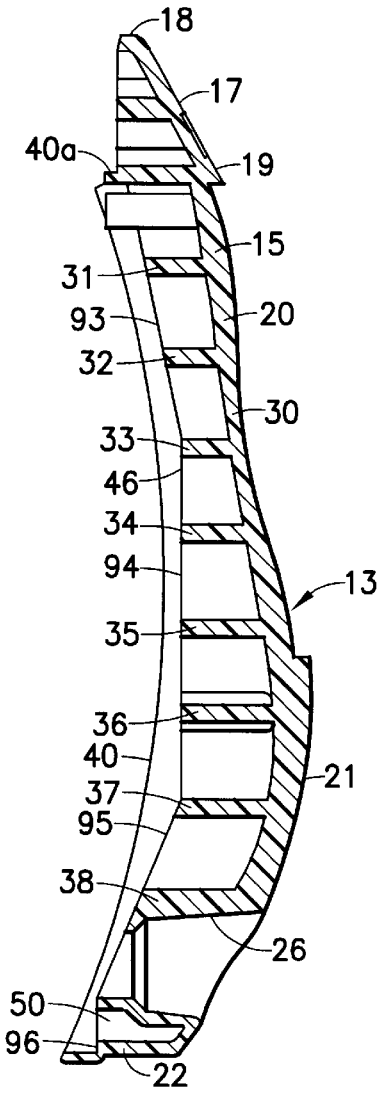
FIG. 11 is a sectional view taken along line 11—11 of FIG. 10.
Figure 12:
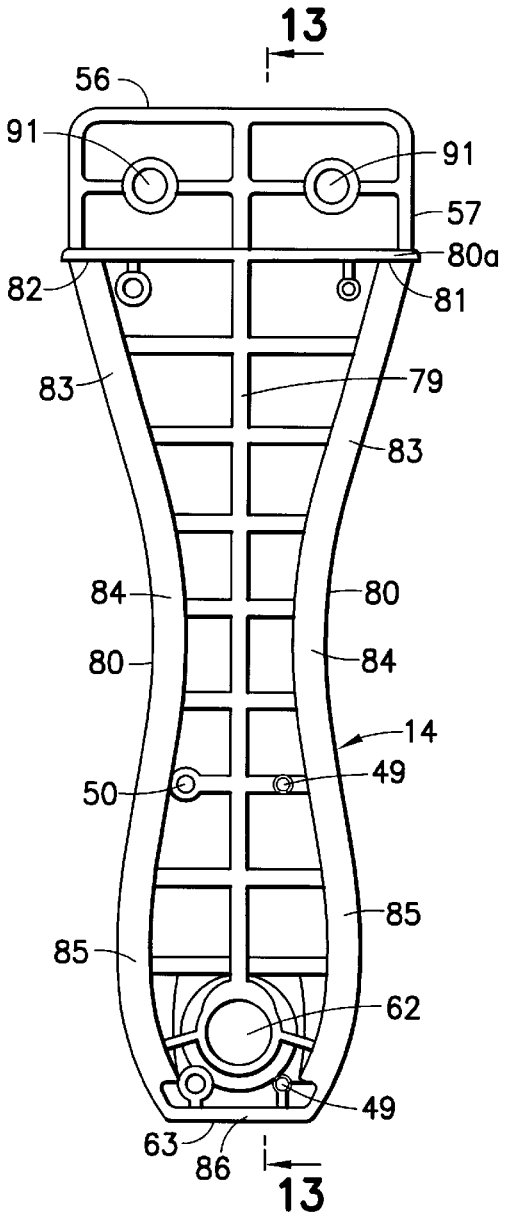
FIG. 12 is a bottom plan view of the lower handle part inner member.

Upper handle part 13 is formed with a series of posts 49 (typical) and holes 50 (typical) for purposes hereinafter appearing (FIG. 10). A pair of through holes 51 are formed in distal end portion 17, for receiving conventional rivets 55 (FIGS. 2 and 10).

Figure 3:
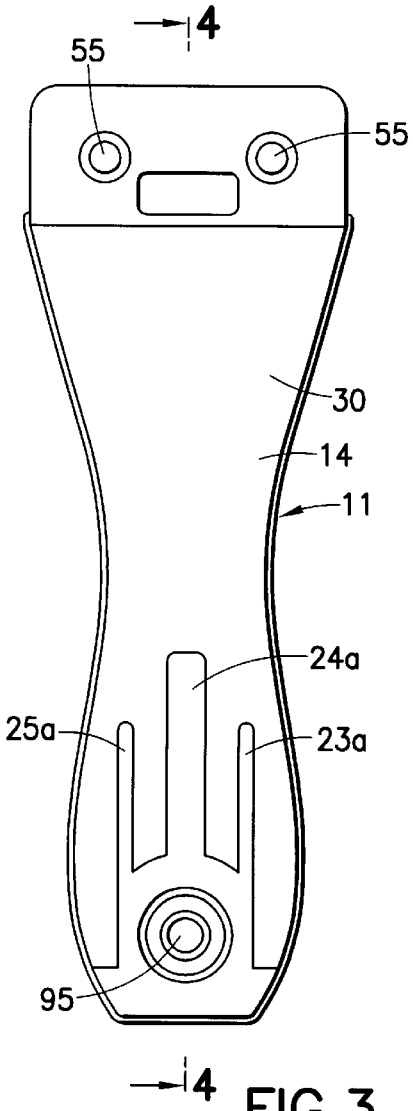
FIG. 3 is a bottom plan view of the assembled handle without the blade.
Figure 4:
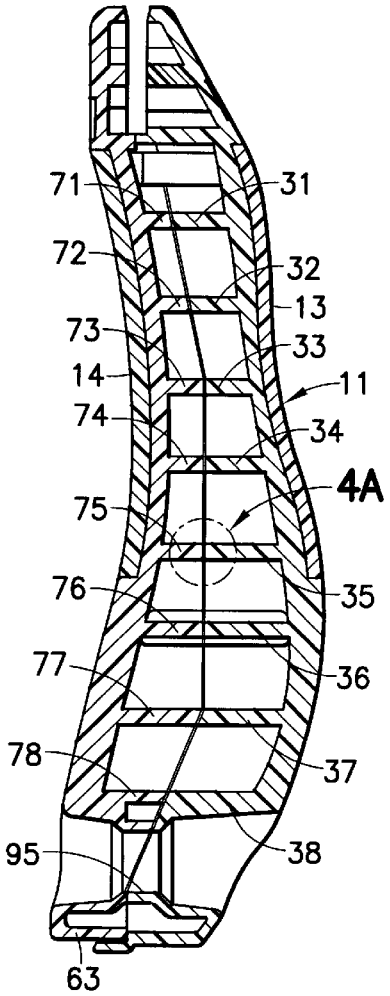
FIG. 4 is a sectional view taken along line 4—4 of FIG. 3.
Figure 4A:
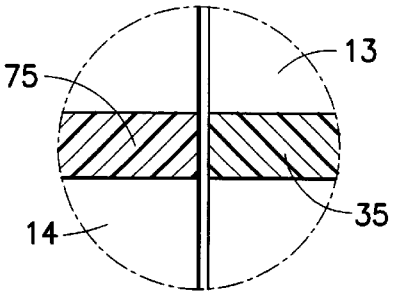
FIG. 4A is greatly enlarged partial fragmentary view of FIG. 4.
Figure 5:
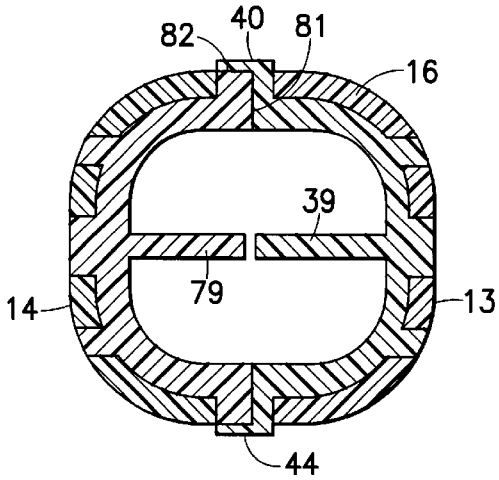
FIG. 5 is a sectional view taken along line 5—5 of FIG. 1.
Figure 6:
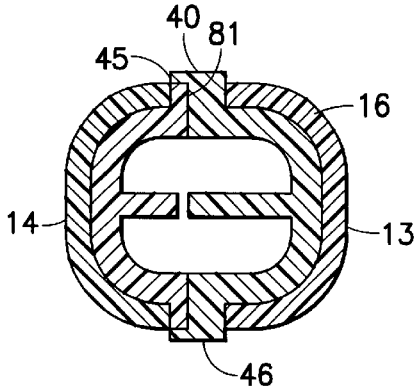
FIG. 6 is a sectional view taken along line 6—6 of FIG. 1.
Figure 7:
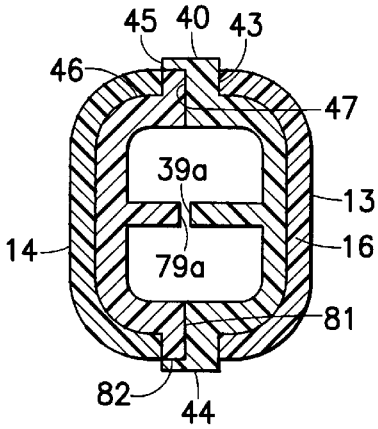
FIG. 7 is a sectional view taken along line 7—7 of FIG. 1.
Figure 8:
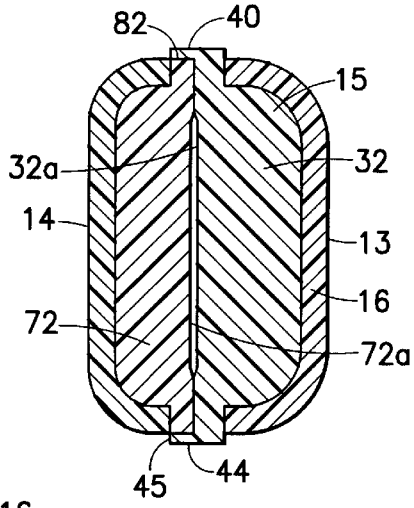
FIG. 8 is a sectional view taken along line 7—7 of FIG. 1.
Figure 9:
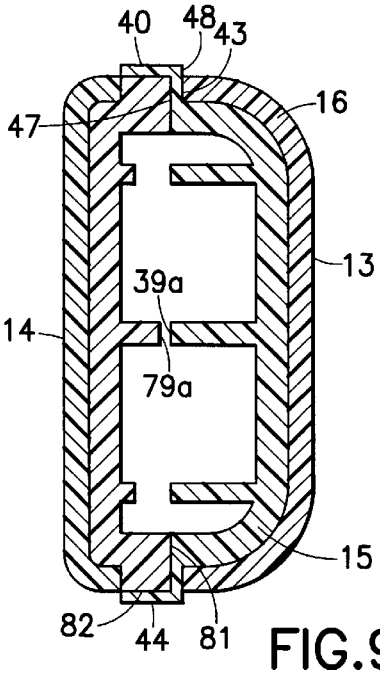
FIG. 9 is a sectional view taken along line 9—9 of FIG. 1.

Lower handle part 14 is formed with a transversely disposed distal end 56, a distal end portion 57, a concave body portion 58 formed with recess 59 for receiving lower part outer grip material or portion 60, a proximately disposed angled portion 61 formed with hole 62, and a transversely disposed proximate end 63. Lower handle part is also formed with three outwardly distally extending ribs 23*a*, 24*a* and 25 (FIG. 3).

Figure 13:
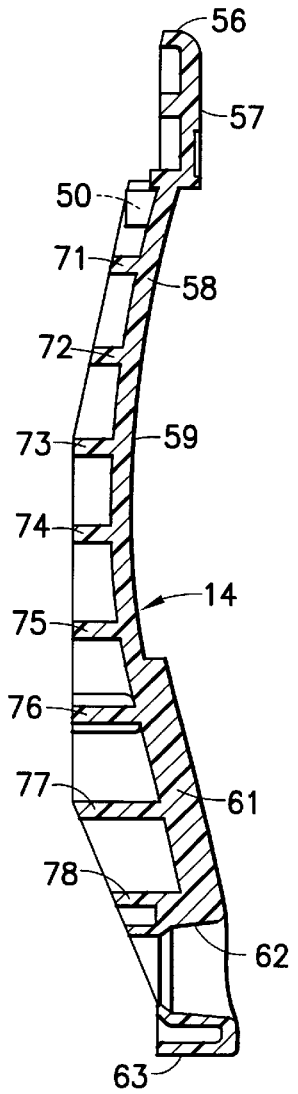
FIG. 13 is a sectional view taken along line 13—13 of FIG. 12.

Lower handle part 14 is formed with a series of transversely disposed ribs 71, 72, 73, 74, 75, 76, 77 and 78 which are interconnected by elongated central rib 79. Ribs 71–79 are for structural purposes. Ribs 31–39 and corresponding ribs 71–79 form a plurality of cavities providing the hollow handle construction (FIGS. 13 and 14).

Lower handle part 14 is formed with a peripheral edge 80 which extends from one side 81 of distal end portion 57 to the other side 82 of distal end portion 57. Edge 80 is also formed with transversely disposed recessed edge 80*a* which completes edge 80 peripheral construction. Edge 80, as best shown in FIG. 5–9, 12 and 13, has a horizontally extending surface 81 and a contiguous transversely disposed vertical surface 82 (FIGS. 5–9). Edge 80 is formed in three angularly disposed segments 83, 84 and 85 on opposite sides of part 14, and connected by contiguous proximately disposed end portion 86. Upper part lip 40 and lower part peripheral edge 80 are cooperatively formed to be slidably contactingly engaged. Lower handle part 14 is also formed with a series of like posts 49 and holes 50, which are similarly sized to frictionally fit the posts 49 and holes 50 of upper handle part 13. Posts 49 extend inwardly further than holes 50 so that parts 13 and 14 are securely inter-engaged. With the parts engaged, upper handle part peripheral lip 40, and particularly surfaces 46 and 47, slidingly contactingly engage lower handle part edge 80 and particularly surfaces 81 and 82 in particular; and surfaces 83, 84 and 85 abut respective surfaces 93, 94 and 95. Lip portion 40*a* and edge 80*a* are in pressing sliding contact to complete the peripheral seal of handle parts 13 and 14.

Holes 91 are formed in lower part distal end portion 57. Holes 91 align with holes 51 to form through holes for receiving rivets 55. Rivets 55 pass through holes 91, 51 and holes (not shown) in blade 12 to secure blade 12 between handle parts 13 and 14. Hole 26 mates with hole 62 to receive grommet 95 to further secure handle parts 13 and 14.

With handle parts 13 and 14 secured, ribs 31–39 are facingly disposed to respective ribs 71–79. Each respective opposing rib is formed with a respective free ends, e.g. 32*a* and 72*a*, and central rib free ends 39*a* and 79*a*. The respective rib free ends e.g. 32*a* and 72*a*, 39*a* and 79*a* are spacedly disposed so that with the rivet and grommet fastening of parts 13 and 14, the parts are forcibly pressed together to a high degree. That is, the opposed ribs do no interfere with but rather accommodate the tight pressing together of handle parts 13 and 14. In this manner, a tight seal is effected between upper part peripheral lip 40 and lower part peripheral edge 80. This forcibly pressed peripheral seal eliminates the need to otherwise seal the periphery of parts 13 and 14. See FIGS. 4–9.

The inner plastic parts 13 and 14 may be formed of any well known hard thermoplastic such as a polyolefin or a glass filled nylon. The outer grip material may be formed of any well known soft thermoplastic material such as a polystyrene. The inner and outer plastic parts may be thermoplastically molded by means well known in the art. It is important to note that the outer grip plastic material has a higher coefficient of friction than the inner plastic material. In this manner of construction, upper exposed ribs 23, 24 and 25 and corresponding lower exposed ribs 23*a*, 24*a* and 25*a* cooperate with the adjacent soft outer grip material to on one hand permit sliding of the handle into a back or side pocket while on the other hand provide positive yet comfortable hand grip. The exposed hard ribs and juxtaposed soft outer plastic configuration may be as shown and described in U.S. Pat. No. 5,956,799, issued Sep. 28, 1999 to Panaccione et al.

While the hand tool of the present invention is described in terms of a broad knife or taping knife, it is understood that the handle of the present invention is useful for other bladed tools, including by way of example cutlery, putty knives and trowels.

While embodiments of the present invention have been described herein with reference to the attached drawings, many modifications and changes may be made by those skilled in this art without departing from the scope of the invention.

What is claimed is:

1. A bladed hand tool comprising:

a handle comprising a first handle part and a second handle part, each part having a respective hand grip portion;

a blade being formed with a working edge;

said first part being formed with an L-shaped peripheral lip and further comprising a peripheral surface, and said second part being formed with a peripheral surface having a first portion extending outwardly and a second portion rectilinearly disposed with respect to the first portion, said second part peripheral surface being disposed inwardly from said peripheral lip second portion; and means for securing said handle parts and the blade so that the first handle part surface and the second handle part surface are in pressing engagement with the blade secured between the parts; and each respective cover and grip portion comprises a soft grippable plastic, wherein the soft grippable plastic does not cover the peripheral lip second portion.

2. The hand tool of claim 1, said blade comprising a taping knife blade.

3. The handle of claim 1, said handle having a distal end and a proximate end, wherein the lip extends around the proximate end and the sides of the first part, but not around the distal end.

4. The hand tool handle of claim 1, said second part peripheral surface contactingly engaging the first part vertical downwardly extending portion.

5. The hand tool handle of claim 4, said first part vertical downwardly extending portion having an end face.

6. The hand tool handle of claim 1, said handle parts comprising a thermoplastic which is harder than the grippable plastic.

* * * * *